US008690594B2

(12) United States Patent
Yeh

(10) Patent No.: US 8,690,594 B2
(45) Date of Patent: Apr. 8, 2014

(54) ELECTRICAL CONNECTOR WITH DUAL RETENTION ELEMENTS

(75) Inventor: Cheng-Chi Yeh, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 92 days.

(21) Appl. No.: 13/349,568

(22) Filed: Jan. 13, 2012

(65) Prior Publication Data

US 2012/0196469 A1 Aug. 2, 2012

(30) Foreign Application Priority Data

Jan. 27, 2011 (TW) ..... 100201778

(51) Int. Cl.
*H01R 13/62* (2006.01)

(52) U.S. Cl.
USPC ..... 439/331

(58) Field of Classification Search
USPC ..... 439/331, 330, 73
See application file for complete search history.

(56) References Cited

U.S. PATENT DOCUMENTS 4,130,327 A * 12/1978 Spaulding ..... 439/71
4,189,201 A * 2/1980 Romania ..... 439/370
4,378,139 A * 3/1983 Griffin et al. ..... 439/331
4,456,318 A * 6/1984 Shibata et al. ..... 439/68
4,504,105 A * 3/1985 Barkus et al. ..... 439/331
4,515,425 A * 5/1985 Nakano ..... 439/73
4,560,217 A * 12/1985 Siano ..... 439/68
4,786,256 A * 11/1988 Angeleri et al. ..... 439/72
5,374,197 A * 12/1994 Uratsuji ..... 439/71
5,531,608 A * 7/1996 Abe ..... 439/330
5,785,535 A * 7/1998 Brodsky et al. ..... 439/73
6,149,449 A * 11/2000 Abe ..... 439/268
6,648,664 B1 * 11/2003 McHugh et al. ..... 439/331
6,945,794 B1 * 9/2005 Yang et al. ..... 439/73
7,278,868 B2 * 10/2007 Sato et al. ..... 439/259
7,517,229 B2 * 4/2009 Ma ..... 439/73
7,666,016 B2 * 2/2010 Kobayashi ..... 439/296
7,708,580 B2 5/2010 Yeh
7,866,987 B2 * 1/2011 Chen ..... 439/73
8,092,231 B2 * 1/2012 Suzuki ..... 439/70
8,251,714 B2 * 8/2012 Yeh ..... 439/73
2010/0184308 A1 * 7/2010 Yeh ..... 439/65

* cited by examiner

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector electrically connecting a chip module to a printed circuit board, has includes an insulative housing having a number of terminals received therein and a loading plate covering on the insulative housing. The loading plate comprises a first rotating element rotatably attached to one end of the insulative housing and a second rotating element rotatably attached to the other end of the insulative housing, the two rotating elements interlocked with each other.

20 Claims, 4 Drawing Sheets

ELECTRICAL CONNECTOR WITH DUAL RETENTION ELEMENTS

BACKGROUND OF THE INVENTION

1. Field of the Invention

The present invention relates to an electrical connector, and more particularly to an electrical connector mounted to a printed circuit board for receiving an Integrated Circuit package.

2. Description of the Prior Art

An electrical connector electrically connecting a chip module to a printed circuit board is described in U.S. Pat. No. 7,708,580, issued to Yeh on May 4, 2010. The electrical connector includes a substantially rectangular insulative housing mounted to the printed circuit board and having a plurality of passageways for receiving a plurality of contacts therein, and a retention member mounted to the printed circuit board and located adjacent the insulative housing to mount a load plate which is capable of rotating relative to the insulative housing between a closed position and an open position. The load plate has one edge connected to the retention member and bent downward, whereby an opening and a pivot section are formed at a middle position of that edge. A pair of stopped section are extending from two opposite sides of pivot section. Another end of the load plate opposite to the retention member is provided with a securing hole, by which a latching member is attached to the load plate and is able to lock the load plate to the closed position. In addition, a gasket is disposed between the securing hole and the latching member. The retention member further has a pair of retaining holes at opposite ends thereof to receive the fasteners.

The electrical connector not only needs the retention member and the fasteners for securing the load plate at one end of the insulative housing, but also needs the latching member for closing the loading plate at the other end of the insulative housing, so it occupies much more space and makes the structure of the electrical connector complicated.

Therefore, it is needed an improved electrical socket to overcome the problems mentioned above.

SUMMARY OF THE INVENTION

Accordingly, an object of the present invention is to provide an electrical connector capable of saving space on the printed circuit board and also reducing the cost.

In order to achieve the object set forth, an electrical connector for connecting a chip module to a printed circuit board, comprises an insulative housing having a plurality of terminals received therein and a loading plate covering on the insulative housing. The loading plate comprises a first rotating element rotatably attached to one end of the insulative housing and a second rotating element rotatably attached to the other end of the insulative housing, the two rotating elements interlocked with each other.

DESCRIPTION OF PREFERRED EMBODIMENT

Figure 1:
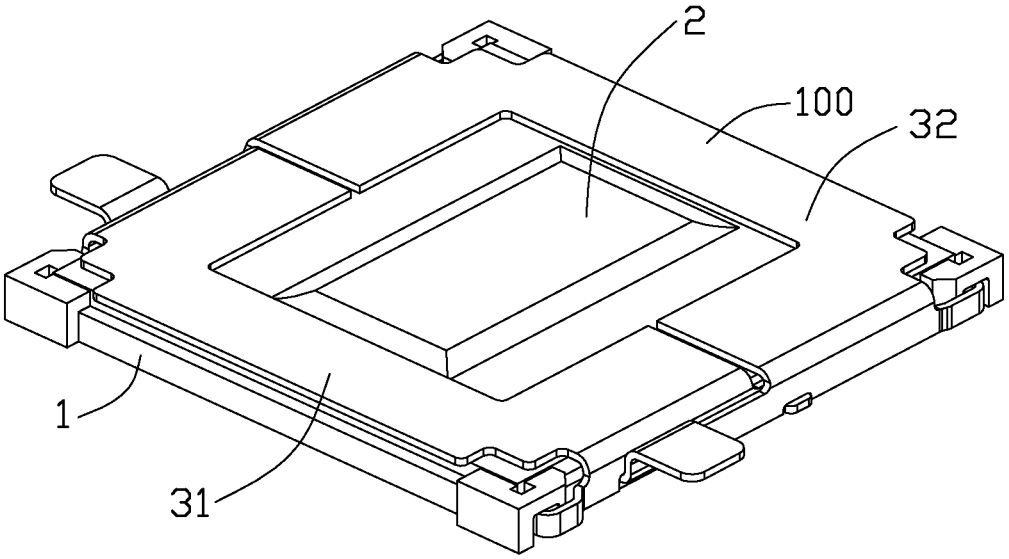
FIG. 1 is a perspective, assembled view of an electrical connector in accordance with a preferred embodiment of the present invention.

Reference will now be made to the drawings to describe the present invention in detail.

Referring to FIGS. 1-4, an electrical connector 100 according to the present invention is used to electrically connect a chip module 2 to a printed circuit board (not shown). The electrical connector 100 comprises an insulative housing 1 having a plurality of terminals (not shown) received therein and a loading plate 3 assembled on the insulative housing 1 for securing the chip module 2.

The insulative housing 1 comprises a body portion 10 with a plurality of passageways (not labeled) for receiving the terminals (not shown) and a plurality of protrusions 11 extending upwardly from the body portion 10 and located at the corners thereof. Two of the protrusions 11 each have a connecting slot 13 at opposite sides of the insulative housing 1 for securing the loading plate 3 to the insulative housing 1. The body portion 10 has a front face 12, a rear face 14 opposite to the front face 12 and a pair of side faces 15.

The loading plate 3 includes a first rotating element 31 and a second rotating element 32 rotatably mounted to the insulative housing 1 and engage with each other for loading the chip module 2. The second rotating element 32 and the first rotating element 31 are secured to opposite ends of the insulative housing 1 respectively.

The first rotating element 31 comprises a U-shaped first base plate 310 which includes two paralleled first arms 312 covered the side faces 15 of the body portion 10 and a first middle portion 311 connected to the first arms 312 and covered the front face 12 of the body portion 10. The first arms 312 extend from the front face 12 to a middle of the side faces 15. The first rotating element 31 also comprises a pair of first extending portions 315 extending downwardly from the first base plate 310 and paralleled to the side faces 15. Each first extending portion 315 has a first mounting portion 318 received in the connecting slot 13 of the insulative housing 1 and close to one end of the first middle portion 311. The first mounting portion 318 extends forwardly and then bending inwardly from the first extending portion 315. The first extending portion 315 also has a first retention groove 314 and a first retention tab 316 extending towards to the rear face 14 and bending outwardly.

The second rotating element 32 comprises a U-shaped second base plate 320 which includes two paralleled second arms 322 covered the side faces 15 of the body portion 10 and a second middle portion 321 connected to the second arms 322 that covered the rear face 14 of the body portion 10. The second arms 322 extend from the rear face 14 to the middle of the side faces 15. The second rotating element 32 also comprises a second extending portion 325 extending downwardly from the second base plate 320 and paralleled to the side faces 15. The second extending portion 325 has a second mounting portion 328 received in the connecting slot 13 of the insulative housing 1 and close to one end of the second middle portion 321. The second mounting portion 328 extends forwardly and then bending inwardly. The second extending portion 325 also has a second retention groove 324 and a second retention tab 326 extending towards the front face 12 and bending outwardly. The second extending portion 325 has a handle portion 327 adjacent to the second retention tab 326. The handle portion 327 bends upwardly and further extends outwardly from the second extending portion 325. A distance is formed between the handle portion 327 and the second retention tab 326 in a vertical direction.

A pair of recesses 16, 17 is formed by the protrusions 11 and close to the front face 12 and the rear face 14 respectively for receiving the first middle portion 311 and the second portion 321. A pair of recesses 18 is formed by the protrusions 11 and close to the side faces 15 for receiving the first extending portion 315 and the second extending portion 325 when the first rotating element 31 and the second rotating element 32 are closed.

Figure 2:
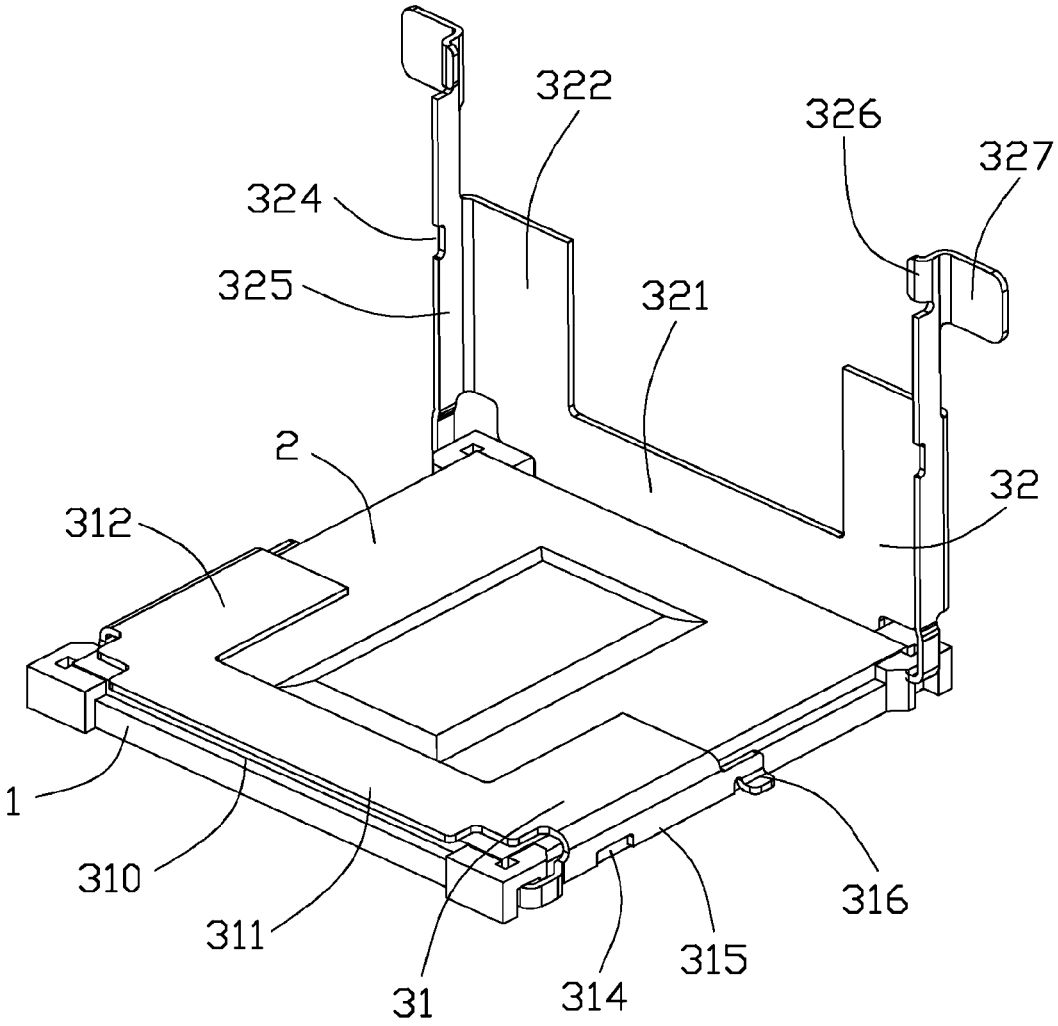
FIG. 2 is an isometric view of the electrical connector shown in FIG. 1 showing the second rotating element is open.
Figure 3:
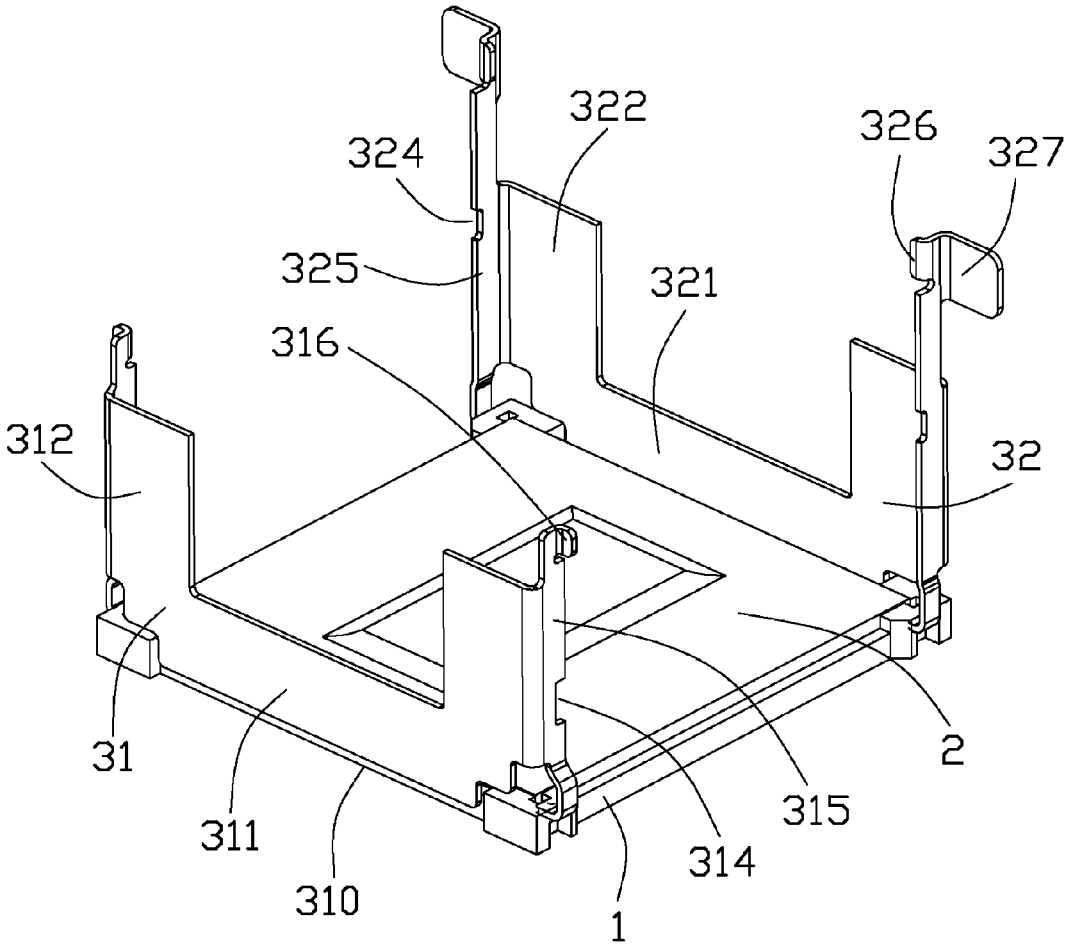
FIG. 3 is an isometric view of the electrical connector shown in FIG. 1 showing the first rotating element is open.
Figure 4:
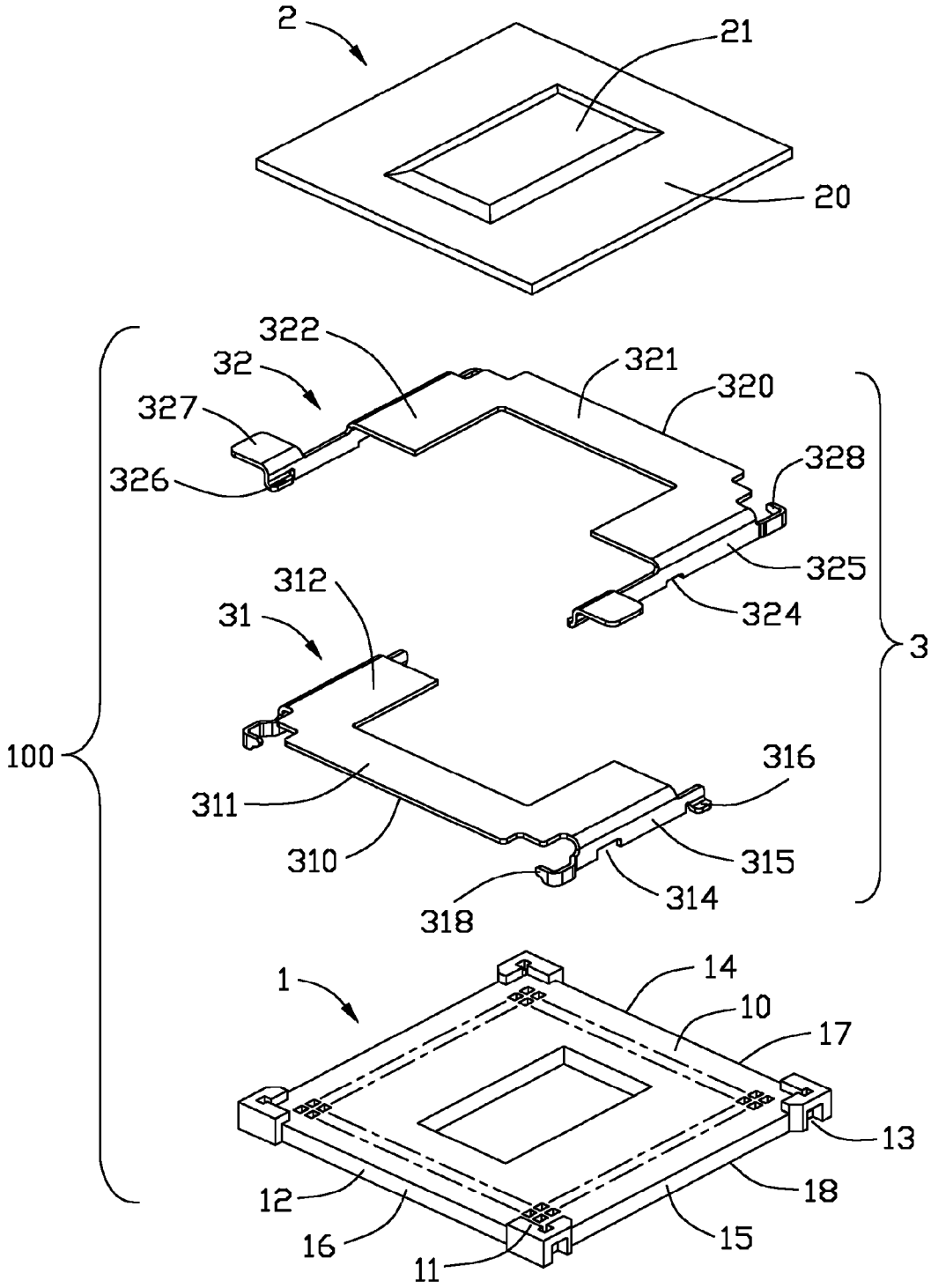
FIG. 4 is an exploded view of the electrical connector as shown in FIG. 1.

Referring to FIGS. 1-3, which show the assembling process of the chip module 2 and the electrical connector 100. Open the second rotating element 32 and the first rotating element 31 in turn and put the chip module 2 on the insulative housing 1. Then, close the first rotating element 31 thereby the first middle portion 311 and the first arms 312 are supported by the chip module 2. Afterwards, close the second rotating element 32 thereby the second rotating element 321 and the second arms 322 are supported by the chip module 2. At this time, the second retention groove 324 engages with the first retention tab 316 and the second retention tab 326 interlocked with the first retention groove 314 to further press the chip module 2 thereby the first rotating element 31 and the second rotating element 32 together apply a load on the chip module 2.

When taking out of the chip module 2, press down the handle portion 327 so that the second retention tab 326 separates from the first retention groove 314, and then open the second rotating element 32 and the first rotating element 31 in turn. The handle portion 327 is convenient to operate. In alternative, the first rotating element 31 and the second portion 32 also engage with the insulative housing 1 instead of engaging with each other.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for connecting a chip module to a printed circuit board, comprising:

an insulative housing having a plurality of terminals received therein; and a loading plate covering on the insulative housing and comprising a first rotating element rotatably attached to one end of the insulative housing and a second rotating element rotatably attached to the other end of the insulative housing, the two rotating elements have an interlocking structure and the two rotating elements interlocked with each other.

2. The electrical connector as claimed in claim 1, wherein the first rotating element comprises a first base plate, and the first base plate includes two paralleled first arms and a first middle portion connected to the two first arms.

3. The electrical connector as claimed in claim 2, wherein the second rotating element comprises a second base plate, and the second base plate includes two paralleled second arms and a second middle portion connected to the two second arms.

4. The electrical connector as claimed in claim 3, wherein the first rotating element comprises a pair of first extending portions extending downwardly from the first base plate, and the second rotating element comprises a pair of second extending portions extending downwardly from the second base plate.

5. The electrical connector as claimed in claim 4, wherein the first extending portion has a first retention groove and a first retention tab, and the second extending portion has a second retention groove and a second retention tab.

6. The electrical connector as claimed in claim 5, wherein the second retention groove engages with the first retention tab, and the second retention tab interlocks with the first retention groove.

7. The electrical connector as claimed in claim 4, wherein the second extending portion has a handle portion at a top end thereof and extending outwardly therefrom.

8. The electrical connector as claimed in claim 1, wherein the second rotating element and the first rotating element are partially overlapped with each other so as to only allow the first rotating element to be rotated to a horizontal position before the second rotating element is rotated to the horizontal position.

9. The electrical connector as claimed in claim 1, wherein the first rotating element and the second rotating element each has a mounting portion bending inwardly and engaging with the insulative housing.

10. An electrical connector for connecting a chip module to a printed circuit board, comprising:

an insulative housing having a plurality of terminals received therein; and a first rotating element and a second rotating element assembled to opposite ends of the insulative housing respectively and rotating relative to the insulative housing, the first and second rotating elements interlocked with each other and formed a receiving space with the insulative housing, the two rotating elements separated with each other, and the two rotating elements interlocked with each other by rotating the two rotating elements relative to the two ends of the insulative housing in a horizontal position respectively.

11. The electrical connector as claimed in claim 10, wherein the insulative housing comprises a body portion and a plurality of protrusions at corners of the body portion, and the protrusions and the body portion form a plurality of recesses therebetween.

12. The electrical connector as claimed in claim 10, wherein said first rotating element and said second rotating element are configured to be partially overlapped with each other so as to only allow the first rotating element to be rotated to a horizontal position before the second rotating element is rotated to the horizontal position.

13. The electrical connector as claimed in claim 11, wherein the first rotating element and the second rotating element each comprise a base plate and an extending portion bending downwardly from the base plate, and wherein the extending portion has a pivot portion at one end thereof mounted to the insulative housing and a retention groove and a retention tab matched with the other rotating element at the other end thereof.

14. The electrical connector as claimed in claim 13, wherein the extending portion is located in a corresponding recesses of the insulative housing.

15. An electrical connector comprising:

an insulative housing defining opposite first and second ends in a transverse direction;

a contact region located in the housing between the first end and the second end;

a loading plate including opposite first and second rotating elements pivotally mounted to the opposite first and second ends, respectively, and back and forth moveable toward and away from each other to cover or uncover the housing; and interlocking means unitarily formed on the first rotating element and the second rotating element for locking the first rotating element and the second rotating element with each other.

16. The electrical connector as claimed in claim 15, wherein said first rotating element and said second rotating element are configured to be partially overlapped with each other so as to only allow the first rotating element to be rotated to a horizontal position before the second rotating element is rotated to the horizontal position.

17. The electrical connector as claimed in claim 16, wherein the first rotating element and said second rotating element are configured to be partially overlapped with each other in a vertical direction perpendicular to said transverse direction to form vertically overlapped portions under condition that the vertically overlapped portions includes a portion of the second rotating element located above and overlapped with another portion of the first rotating element in said vertical direction.

18. The electrical connector as claimed in claim 17, wherein said first rotating element and said second rotating element are configured to be further partially overlapped with each other in a lengthwise direction perpendicular to both said transverse direction and said vertical direction around the vertically overlapped portions.

19. The electrical connector as claimed in claim 15, wherein the first rotating element and said second rotating element are configured to be partially overlapped with each other in a lengthwise direction perpendicular to said transverse direction for performing interlocking.

20. The electrical connector as claimed in claim 17, wherein the first rotating element and said second rotating element are configured to be partially overlapped with each other in a vertical direction perpendicular to both said transverse direction and said lengthwise direction.

* * * * *